US009260963B2

(12) United States Patent
Goodwin et al.

(10) Patent No.: US 9,260,963 B2
(45) Date of Patent: Feb. 16, 2016

(54) ACOUSTIC DETERMINATION OF THE POSITION OF A PISTON WITHIN A SAMPLE BOTTLE

(71) Applicant: Schlumberger Technology Corporation, Sugar Land, TX (US)

(72) Inventors: Anthony R. H. Goodwin, Sugar Land, TX (US); Thomas Meyer, Manvel, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 292 days.

(21) Appl. No.: 13/935,207

(22) Filed: Jul. 3, 2013

(65) Prior Publication Data

US 2015/0007647 A1 Jan. 8, 2015

(51) Int. Cl.
*E21B 47/10* (2012.01)
*E21B 49/08* (2006.01)

(52) U.S. Cl.
CPC ..... *E21B 49/084* (2013.01); *E21B 49/081* (2013.01)

(58) Field of Classification Search
CPC ..... E21B 47/101; E21B 49/081
USPC ..... 73/152.23
See application file for complete search history.

(56) References Cited

U.S. PATENT DOCUMENTS

| | | | | |
|---|---|---|---|---|
| 5,302,878 | A * | 4/1994 | Soucemarianadin et al. | 310/360 |
| 6,035,718 | A * | 3/2000 | Lucas | 73/630 |
| 6,112,599 | A * | 9/2000 | Maki, Jr. | 73/801 |
| 6,119,579 | A * | 9/2000 | Pawelski | 92/5 R |
| 6,435,279 | B1 * | 8/2002 | Howe et al. | 166/336 |
| 6,722,261 | B1 * | 4/2004 | Brown et al. | 92/5 R |
| 6,730,029 | B1 * | 5/2004 | Moriya et al. | 600/437 |
| 7,062,958 | B2 | 6/2006 | Diakonov et al. | |
| 2002/0083826 | A1 * | 7/2002 | Arshad et al. | 92/5 R |
| 2006/0174717 | A1 * | 8/2006 | Ishikawa | 73/861.25 |
| 2009/0025460 | A1 * | 1/2009 | Hurmuzlu et al. | 73/61.45 |
| 2015/0007986 | A1 * | 1/2015 | Goodwin et al. | 166/255.2 |

FOREIGN PATENT DOCUMENTS

GB 2377952 A 1/2003

* cited by examiner

*Primary Examiner* — J M Saint Surin
(74) *Attorney, Agent, or Firm* — Kenneth L. Kincaid

(57) ABSTRACT

A method to determine a piston position in a sample bottle, having steps of providing a transducer near a chamber of the sample bottle, exciting the transducer to provide at least one wave of acoustic energy, propagating the acoustic energy through the chamber to a surface, reflecting the acoustic energy from the surface, receiving the acoustic energy at a receiver, determining a time of flight of the acoustic energy, and calculating the piston position from the time of flight of the acoustic energy.

16 Claims, 3 Drawing Sheets

ACOUSTIC DETERMINATION OF THE POSITION OF A PISTON WITHIN A SAMPLE BOTTLE

CROSS-REFERENCE TO RELATED APPLICATIONS

None.

FIELD OF THE INVENTION

Aspects relate to sample acquisition of downhole formation fluids. More specifically, aspects relate to modular dynamics tester sample retention through piston position measurement by acoustic methods.

BACKGROUND INFORMATION

The Modular Dynamics Tester (MDT) is an instrument used to acquire aliquots of reservoir fluid for analyses and transportation. The reservoir fluid is drawn into the MDT through a probe in-contact with the bore-hole wall by reducing the pressure within the MDT tubular, which contains bore-hole fluid, from the pressure of the formation. The pressure reduction is generated by a positive displacement pump operated by hydraulic fluid. When the fluid within the tubular is, for all intensive purposes, free of drilling fluid, as determined by the interpretation of independent measurements on the flow-line, the reservoir fluid is directed into the sample bottle. The position of the piston within the sample bottle and thus the intake of fluid are not currently determined.

Department of Transportation ("DOT") certified bottles are used to move fluid from the well-site to the laboratory. These may contain hydraulic fluid and, in one case, a nitrogen buffer to significantly reduce the pressure reduction arising from a temperature decrease. Ideally, for any replacement reservoir fluid sampling instrument, the sample collection vessel will include the $N_2$(g) buffer and be DOT certified and for the remainder of this the description will assume this is so.

Current apparatus do not accurately determine piston position during fluid withdrawal activities. The methods provided and the apparatus for conventional systems do not provide sufficient resolution to allow operators control to the desired level.

SUMMARY

A method to determine a piston position in a sample bottle, comprising: providing a transducer near a chamber of the sample bottle, exciting the transducer to provide at least one wave of acoustic energy, propagating the acoustic energy through the chamber to a surface, reflecting the acoustic energy from the surface, receiving the acoustic energy at a receiver; determining a time of flight of the acoustic energy, and calculating the piston position from the time of flight of the acoustic energy.

DETAILED DESCRIPTION

Figure 1:
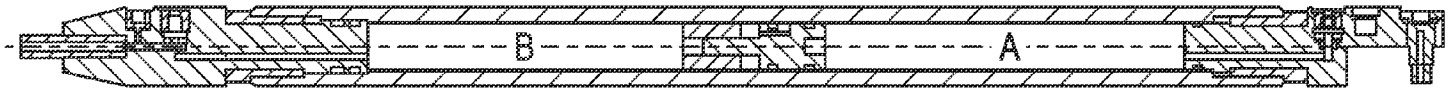
FIG. 1 is a cross-section through a sample bottle used in a Modular Dynamics Tester containing a hydraulic fluid A and a reservoir fluid B.

The approach advocated for the aspects described is to determine the position of the piston surface utilizes measurement of the time of flight of a pulse of sound combined with knowledge of the speed of sound. The speed of sound for the fluid can be determined by two methods as follows: (A), from a correlation of independent measurements of the speed of sound in the fluid; and (B), from in situ measurement of the speed of sound of the fluid contained in the hydraulic mechanism of the pump. Embodiments proposed are described below. The transducer T may be installed in the sample side of the vessel (sample bottle) and used to determine the acoustic properties of the reservoir fluid that include phase equilibrium and thus sample validation.

Two methods may be used to determine the speed of sound u in liquids: variable path length interferometry and time-of-flight measurements. This choice arises with liquids because the acoustic impedance of the fluid pu, where p is the density, is comparable with that of the wall material; the ratio $pu/p_w u_w$, where the subscript w refers to the wall material, is for liquids on order 0.1. This ratio governs sound reflection and energy transfer between the two media. Thus, steady state measurements that are used for gases are inappropriate for sound speed measurements because of coupling between the fluid and wall motion. Nevertheless, spherical resonators may be used to measure the sound speed in liquids with resonators of internal volume between (0.5 and 100) $dm^3$. An advantage of the coupling between the motion of the shell and the liquid is that the transducers can be placed on the outer surface of the cavity and do not need to come in contact with the fluid under test. Piezoelectric ceramic elements may be cemented or affixed outside the shell. If the value of acoustic impedance of the shell is made small, then a pressure release boundary condition may be used to describe the frequencies within the cavity. This approach has an additional advantage that the viscous and thermal boundary losses vanish.

Experimental methods of measuring the speed of sound (and absorption which provides in principle transport properties) in liquids and the theory of operation of these techniques have been reviewed, at frequencies in the range ($10^3$ to $10^9$) Hz, elsewhere. Many of the methods described for solids can also be used for liquids with minor adaptations.

Time of flight methods can be divided into single and multiple path length devices. A single path time-of-flight measurement is used for the measurement described. Here, several examples of devices used to determine the speed of sound in liquids, including natural fluids, at elevated pressure and temperature are presented. A time-of-flight apparatus with two transducers is used to study the acoustic properties of pure hydrocarbons and mixtures including reservoir fluids.

In one embodiment, a single path pulse echo apparatus is provided to determine the sound speed at high pressure in pure hydrocarbons, prepared mixtures and natural fossil fuels at reservoir conditions. This instrument is used to detect phase boundaries including liquid-liquid phase equilibrium and this approach is used to evaluate the reservoir fluid entering the bottle and also ensure the fluid is maintained in a single phase or if the fluid has undergone a phase transition. The design of the reflector R may be optimized for associated acoustic characteristics, for example, in single pulse echo overlap methods R was chosen to reduce reflections or back-coupling from the transducer. The sound speed was determined from a combination of the path length and the time required between success pulses to create overlap of the pulses.

In one embodiment, an apparatus uses a transducer to emit pulses simultaneously in opposite directions and the two returning bursts that had travelled different distances are determined. The time at which a characteristic feature of the first returning echo on the shorter path and the time at which the second echo returned over the longer path are detected.

An advantage of determining differences in transit time is that reflection and electronic delays can be reduced. The transit times can be determined directly from an oscilloscope; however, the resolution may be increased by analysis of the digitized wave-form. In this analysis, in an example embodiment, about 10 cycles of the first echo was selected and, after assuming a delay time, compared with about 10 cycles from the second echo. The analysis was repeated for a series of time differences and optimum value determined. The path length was calibrated by measurement with water at temperature and pressure. Alternatively, a comparison can be made at one temperature and pressure and the variation of L with temperature and pressure was calculated from the coefficients of thermal expansion and compressibility of quartz and stainless steel.

Diffraction of the signal is present in all pulse measurements. To ensure the cavity walls do not affect the acoustic signal as the signal passes through the fluid, the cavity may be significantly greater in diameter than the source. Diffraction effects are estimated from the steady-state radiation pattern of the source and a cell diameter chosen so that an insignificant fraction of the acoustic energy impinges on the walls. A second effect of signal diffraction is that diffraction causes the measured transit time to be in error because of the phase advance $\phi$ of the sound wave relative to a plane wave traveling the same distance. To correct for this error, the transit time may be increased by $\delta t$, given by:

$$\delta t = \frac{\phi(L)}{2\pi f}, \qquad \text{EQ. 1}$$

where f is the frequency of the source, L the path length and $\phi$ the phase advance determined either numerically or analytically from the free field diffraction equation:

$$A\exp(i\phi) = 1 - \frac{4}{\pi}\int_0^{\pi/2} \exp\left[-\left(\frac{4b^2\pi i}{L\lambda}\right)\cos^2\theta\right]\sin^2\theta\, d\theta, \qquad \text{EQ. 2}$$

where b represents the radius of the source. The factor Aexp ($i\phi$) provides a complete description of the free-field diffraction effects for a piston like source and a parallel detector of the same radius that responds to the acoustic pressure over its surface. It is valid for a single transducer multiple reflector device provided the diameter of the reflector is equal or greater than that of the transducer. It has been shown that the effect of the side wall on the sound speed in a cylindrical cavity is negligible when the ratio of radius of the sample to that of the transducer is greater than 2.

A single transducer variable path length device may be used to study liquids. In this measurement, a single stationary quartz crystal transducer is used. Impedance circles are used to establish the location of each half wavelength and position of the reflector was determined with an optical interferometer. The interferometer for measurements at pressure has a sliding non-rotating shaft that held the reflector.

A phase sensitive detection scheme for pulse measurements may be used to determine the height of the mercury column in a manometer. In this approach, an ultrasonic pulse is propagated through a sample and reflected back to the transducer. The phase of the echo is then compared with that of the continuous wave used to generate the pulse. The advantage of this approach is that it can be used over a wide range of length or sound speeds.

All of these concepts are utilized in one apparatus that combines pulse techniques, phase sensitive detection, and variable path length interferometry to measure the speed of sound in liquids. In this apparatus, the source transducer is attached to one end of a quartz rod and a pulse of sound, which is obtained from a continuous wave source, propagates from the transducer through a quartz buffer, through the fluid and is reflected at a parallel movable plate. Buffer rods have advantages including the reduction of multiple reflections from the transducer. Two echoes are observed, one that arises from a reflection at the interface between the rod and the sample and the other from part of the pulse that travels through the sample and is reflected at the moving reflector back to the transducer. The difference in phase between each echo and the continuous wave reference, used to generate the pulse, can be determined with phase sensitive detectors or from measurements as a function of varying path length. The difference in distance travelled between the two echoes d is determined by the number of half wavelength constructive interference in the fluid or fringes Fat a frequency given by:

$$F = \frac{d}{\lambda} = n + \frac{1}{2} + \frac{\theta_2 - \theta_1}{2\pi}, \qquad \text{EQ. 3}$$

where $\lambda$ is the wavelength, n is an integer number of fringes, ½ describes the phase change on reflection at the interface between the buffer and the fluid, $\theta$ is the phase difference between the pulse and the continuous wave reference, and the subscripts 1 and 2 refer to the first and second echo respectively. The wavelength is then determined from the change in path length d required to observe an additional fringe. In practice, the path length is changed over about 100 fringes. The speed of sound is then determined from the wavelength and the frequency.

In a non-limiting embodiment, a dual transducer variable path length interferometer may be used at temperatures over 2000 K. To prevent heating, the $LiNbO_3$ piezoelectric crystals above the Curie temperature (about 1423 K), each one crystal is cemented on one end of a 0.2 m long and 12.7 mm diameter $Al_2O_3$ rod and located in a water-cooled jacket. The sound from the transducers, which were situated at a lower temperature, was propagated along the rods into the liquid sample. This approach has also been used with time-of-flight measurements at high temperatures. To ensure parallelism of the transducer rod and rod sample interfaces, important to interferometery, both ends of the rods were polished flat to within 1 μm. The lower rod was attached into the vessel while the upper rod could be moved and the position determined with a linear variable displacement transducer. Graphite sleeves may be used to eliminate errors from beam spreading and reflections that arise from thermally induced variations in acoustic impedance. The latter can be reduced with graphite sleeves. The variable path interferometer does not require, at constant temperature, corrections for the variations in sound speed with temperature along the rod. The ratio of the acoustic impedance of the $Al_2O_3$ rod, however, to that of the Fe(I) was about 1.4 and this value contributed to the larger than desired uncertainty with which the amplitude maxima could be located and thus the few per cent uncertainty in the speed of sound. A single transducer variable path length interferometer has been described, along with other methods of measuring the speed and attenuation of sound, in liquid metals. Buffer rods offer another advantage in that the buffer rods eliminate contact between the transducer and the sample. In one embodiment, another advantage is afforded by the ability to house the transducer within the tool and connect it with, for example, a spring, to the buffer rod that is permanently installed in the sample bottle. In this embodiment, the bottle does not contain the transducer and in the case this component fails to operate, the transducer can be replaced without removing the sample.

The transducers that convert mechanical work into electrical work or vice versa, and used to generate and detect sound are an important component of an apparatus to measure the speed of sound. In example embodiments, the transducers may satisfy certain criteria before they are used for the measurements. In the example embodiments, the transducers have low output power so as not to perturb thermal equilibrium within the cavity and operate over a wide temperature and pressure range and be chemically inert while maintaining an acceptable signal-to-noise ratio. Additionally, for resonators, the transducers may have a wide frequency bandwidth that also present high acoustic impedance to the fluid. For variable path length fixed frequency interferometers, the transducers are operated close to a mechanical resonance where the electrical impedance of the device is determined mainly by the impedance of the load. For pulsed operation, the frequency is also fixed but the bandwidth is larger to achieve useful time-domain resolution. Transducers are thus formed from piezoelectric elements, electromagnetic, devices, capacitive based methods and lasers.

In the configuration shown in FIG. 1, the piston position within the hydraulic fluid is not currently determined. Providing continuous measurements of piston location would provide a way to determine that the bottle is functioning and acquiring fluid. If the time-of-flight measurement was also included on the sample side it would provide phase equilibrium and thus sample validation.

Figure 2:
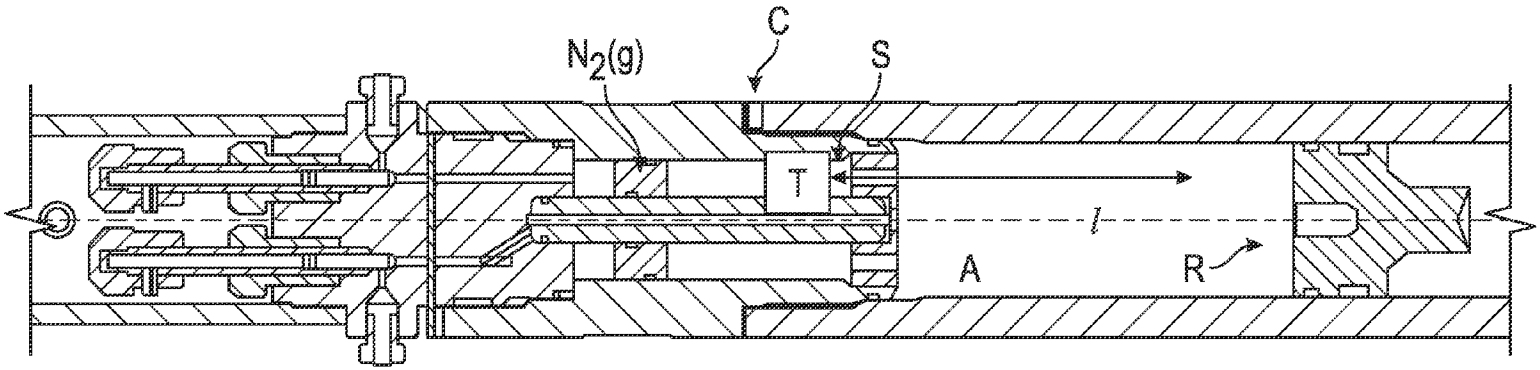
FIG. 2 is an expanded view of an acoustic transducer T used in conjunction with the Modular Dynamics Tester.
Figure 3:
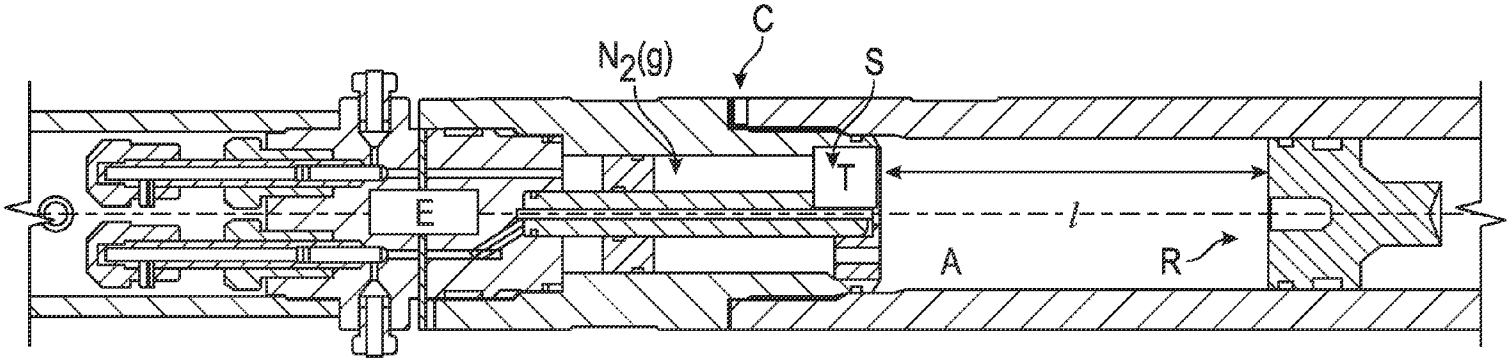
FIG. 3 is a cross-section of FIG. 2 that includes an electronics module E used to determine distance l.

Methods that may be used to determine the position of the piston within the cylinder and these include, but are not limited to, the following: (1), a Linear-Variable Displacement Transducer (LVDT) as provide by a rod moving within a toroidal magnet, (2), a magnetic positioned outside the cylinder moving in response to the piston position and detected with a method analogous to item 1, and (3), acoustic methods. FIGS. 2 and 3 illustrate an acoustic transducer T that is located flush with the cylinder end as illustrated in FIGS. 2 and 3. The sound emitted as a pulse by T is reflected, by the acoustic impedance mis-match, at the surface R, which is parallel with T, and travels a distance 2 l before arrival at the transducer T that is now acting as a receiver. The surface R is on a piston that is parallel with the surface of T and moves within the cylinder C. From knowledge of the speed of sound u, of sufficient certainty for the purpose intended, in the fluid through which the sound traverses the length l can be determined from:

$$l = \frac{ut}{2}. \qquad \text{EQ. 4}$$

The measurement of l relies on a single piezoelectric transducer, which is used as both the source and detector of ultrasonic pulses. The transducer T is placed in front of a plane parallel reflector. In practice, the transducer T is energized with a suitable tone burst to emit ultrasonic pulses from the surface. The pulse travels through the fluid to the corresponding reflector R and then returns to the transducer T which, now operating as a receiver, detects the arrival. The path length travelled by the pulse is twice the distance separating the source and reflector l and occurs in a transit time t. FIG. 3 shows a plausible location of the electronics required to provide l and communicate the data with the other electronics within the formation tester.

Corrections to Eq. (4) for the effects of diffraction may be significant under some circumstances and these include the presence of temperature variations and to a lesser extent pressure, within the hydraulic fluid give rise to variations of acoustic impedance and thus result in diffraction. In the embodiment illustrated, these variations are estimated to be negligible from Eq. (2), provided the bottle is in thermal contact with the bore-hole fluid.

The speed of sound can be determined by two methods and these are as follows: (A), from a correlation of independent measurements of the speed of sound in the fluid; and (B), from in situ measurement of the speed of sound of the fluid contained in the hydraulic mechanism of the pump. Each of these two plausible methods will be described in the order listed.

For item A, the speed of sound as a function of both temperature and pressure for Univis J26, which is typically used as the hydraulic fluid within reservoir fluid formation testers, has been determined from time-of-flight measurements at temperatures between (20 and 150)° C. and pressure below 68 MPa with an uncertainty of about ±0.5%; the path-length of the apparatus used to determine the speed of sound was determined from measurements of the time-of-flight in water for which the speed of sound is known with an uncertainty of about ±0.1% at the conditions of interest. The results were fit, within the experimental uncertainty, by the polynomial:

$$\frac{u(t,\ p)}{m \cdot s^{-1}} = 1449.2 + 0.0103 \cdot \left(\frac{p}{\text{MPa}}\right)\left(\frac{t}{^\circ\text{C.}}\right) + 3.8002 \cdot \left(\frac{p}{\text{MPa}}\right) - 2.8661 \cdot \left(\frac{t}{^\circ\text{C.}}\right). \qquad (1)$$

Thus, l can be determined for Univis J26 with an uncertainty of <±1.5% from a combination of measurements of t with Eq. 4. For other hydraulic fluids an alternative correlation of measured sound speeds may be performed.

Knowledge of the piston position within the bottle provides the assurance the bottle contains a sample. When the transducer is also installed on the sample side the acoustic properties of the sample can be determined and these include the occurrence of a phase border.

The transducer tone burst can be at, for example, a frequency of about 4 MHz. The exact frequency can be varied to maintain an optimal maximum amplitude that ensures propagation through the fluid, reflection and detection. The time for which the burst is produced can be varied to accommodate the rate of change of distance with respect to time and is on the order of 10 μs.

Figure 4:
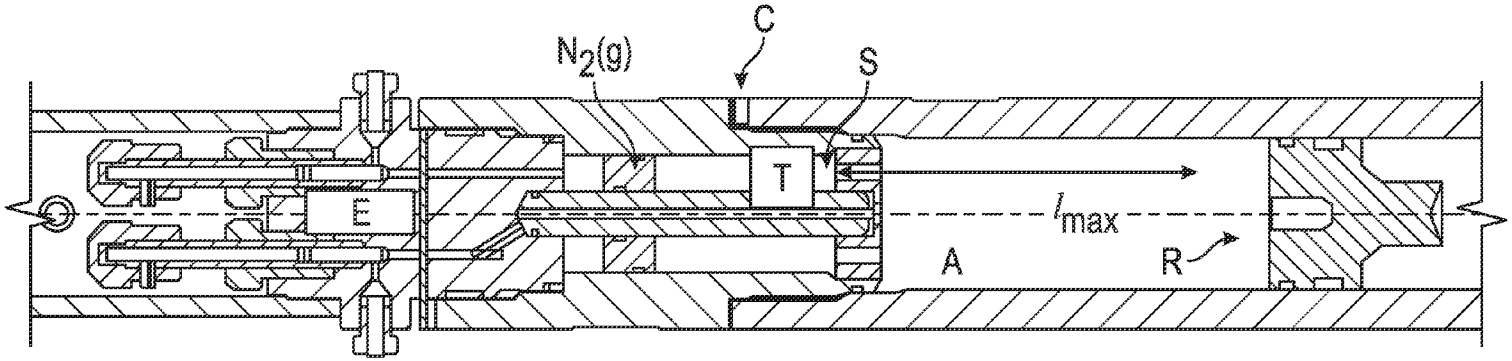
FIG. 4 is a cross-section of a sample bottle wherein the speed of sound is determined from measurement of t when the piston surface R is located a maximum distance $l_{max}$.
Figure 5:
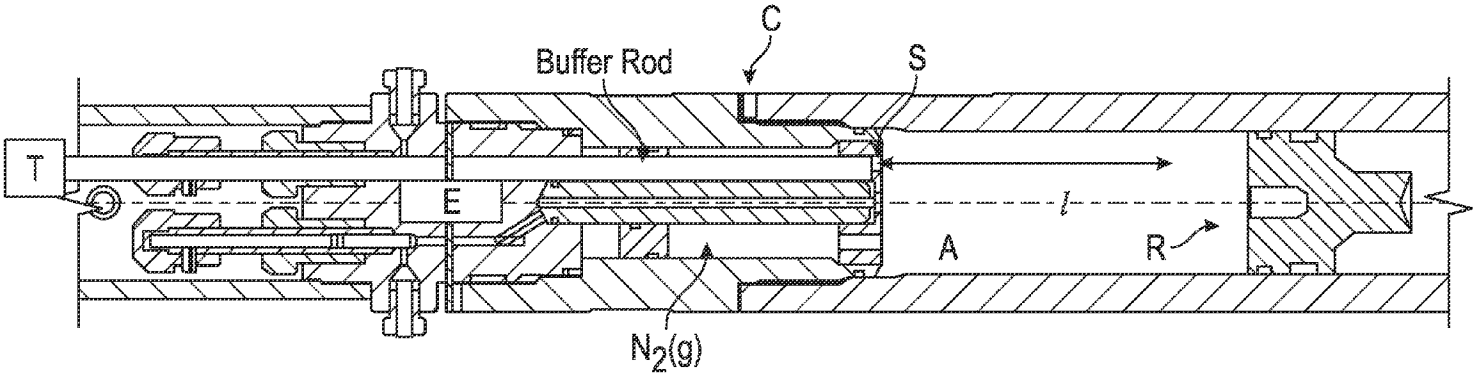
FIG. 5 is a cross section of the sample bottle where a buffer rod is shown with the transducer T located outside the pressure vessel.

For alternative B, item B uses in situ measurement of the speed of sound of the fluid contained in the hydraulic mechanism that can be achieved by several ways that include at least the following: (1), the same transducer when the piston is located at a known length from the transducer T, for example, the maximum distance $l_{max}$ as shown in FIG. 4; or (2), by the addition of a cavity either attached to or near the hydraulic fluid chamber A of FIG. 1, 2 and 3; or (3), a measurement of the sound speed, for example, provided by a clamp-on Doppler flow-meter attached to a tube within the formation tester that supplies hydraulic fluid to the displacement pump. Item 3 is not illustrated here but can be arranged to provide both a measure of flow-rate and speed of sound in the fluid. Item 1 requires the determination of $l_{max}$ when the chamber A is filled with water.

Figure 6:
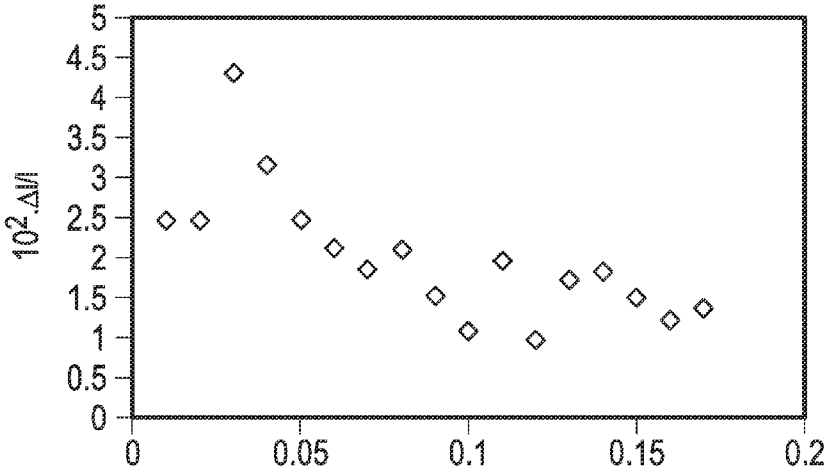
FIG. 6 is a graph of a Fraction Difference $\Delta l/l$ as a function of distance l determined with a ruler.

To demonstrate the determination of piston position time-of-flight measurements of the distance between the transducer and a moving piston, which was located within a pseudo bottle fabricated from translucent plastic, were compared with those obtained from a ruler. Here, the time of flight of a sound pulse was combined with the speed of sound in J26 at ambient pressure of about 0.1 MPa and temperature of about 24° C. The distances obtained from time-of-flight measurements are shown in FIG. 6 as relative differences from those determined with a ruler placed along the cylinder wall.

The fractional differences $\Delta l/l$ so determined vary from about 1% at $l>0.1$ m to 4% at $l=0.03$ m. The larger than expected difference arises from reading the distance travelled with a ruler owing to the effect of no-parallax. Indeed, the largest contribution to the error arises from the scale and contributes an absolute uncertainty of about 1 mm. This provides a greater contribution to the uncertainty $\delta l/l$ as l decreases; for example, for $l=20$ mm and $\delta l=1$ mm $10^2 \cdot \delta l/l=5\%$ that is consistent with the result shown in FIG. 6. Not surprisingly, this results, as shown in FIG. 6, in a rather inferior measurement at $l<0.08$ m.

In one non-limiting embodiment, a method to determine a piston position in a sample bottle is provided, comprising: providing a transducer near a chamber of the sample bottle, exciting the transducer to provide at least one wave of acoustic energy; propagating the acoustic energy through the chamber to a surface; reflecting the acoustic energy from the surface; receiving the acoustic energy at a receiver; determining a time of flight of the acoustic energy; and calculating the piston position from the time of flight of the acoustic energy.

In another non-limiting embodiment, the method may be accomplished wherein the transducer is further configured to be the receiver.

In another non-limiting embodiment, the method may be accomplished wherein the transducer produces at least two waves of acoustic energy, wherein a first wave of the acoustic energy is propagated through the chamber in a direction opposite to a second wave of the acoustic energy.

In another non-limiting embodiment, the method may be accomplished wherein that transducer is a component of a variable path length fixed frequency interferometer.

In another non-limiting embodiment, the method may be accomplished wherein a frequency of the acoustic energy is approximately 4 MHz.

In another non-limiting embodiment, the method may be accomplished wherein the transducer is located at an end of the chamber.

In another non-limiting embodiment, the method may be accomplished wherein the surface is a surface of the piston.

In another non-limiting embodiment, the method may be accomplished wherein a diameter of the chamber is at least twice as large as a diameter of the transducer.

In another non-limiting embodiment, the method may be accomplished wherein the transducer is attached to an end of a quartz rod.

In another non-limiting embodiment, the method may further comprise digitizing a wave form of the received acoustic energy and analyzing the digitized wave form.

While the aspects has been described with respect to a limited number of embodiments, those skilled in the art, having benefit of this disclosure, will appreciate that other embodiments can be devised which do not depart from the scope of the disclosure herein.

What is claimed is:

1. A method to determine a piston position in a sample bottle of a downhole tool, comprising:
- collecting a sample in the sample bottle;
- providing a transducer near a chamber of the sample bottle;
- exciting the transducer to provide at least one wave of acoustic energy;
- propagating the acoustic energy through the chamber to a surface in a direction parallel to a direction traveled by the piston;
- reflecting the acoustic energy from the surface;
- receiving the acoustic energy at a receiver;
- determining a time of flight of the acoustic energy; and
- calculating the piston position from the time of flight of the acoustic energy.

2. The method according to claim 1, wherein the transducer is further configured to be the receiver.

3. The method according to claim 1, wherein the transducer produces at least two waves of acoustic energy, wherein a first wave of the acoustic energy is propagated through the chamber in a direction opposite to a second wave of the acoustic energy.

4. The method according to claim 3, further comprising:
- digitizing a wave form of the received acoustic energy; and
- analyzing the digitized wave form.

5. The method according to claim 1, wherein the transducer is a component of a variable path length fixed frequency interferometer.

6. The method according to claim 1, wherein a frequency of the acoustic energy is approximately 4 MHz.

7. The method according to claim 1, wherein the transducer is located at a flat end of the chamber.

8. The method according to claim 1, wherein the surface is a flat surface of the piston.

9. The method according to claim 1, wherein a diameter of the chamber is at least twice as large as a diameter of the transducer.

10. The method according to claim 1, wherein the transducer is attached to an end of a quartz rod.

11. The method according to claim 1, wherein the transducer is one of affixed to the chamber and a component of the downhole tool.

12. The method according to claim 1, wherein a speed of sound for the time of flight calculations is a value based upon a laboratory test.

13. The method according to claim 1, wherein a speed of sound for the time of flight calculations is a value determined by a Doppler flow meter.

14. The method according to claim 1, wherein a speed of sound for the time of flight calculations is a value determined as a function of both temperature and pressure for Univis J26.

15. The method according to claim 1, wherein the transducer is not located along a cylindrical side wall of the chamber.

16. The method according to claim 1, comprising:

moving the piston to a second piston position in the sample bottle;

exciting the transducer to provide a second at least one wave of acoustic energy;

propagating the second acoustic energy through the chamber to the surface;

reflecting the second acoustic energy from the surface;

receiving the second acoustic energy at the receiver;

determining the time of flight of the second acoustic energy; and calculating a second piston position from the time of flight of the second acoustic energy.

* * * * *